US005775928A

United States Patent [19]

Booker et al.

[11] Patent Number: 5,775,928

[45] Date of Patent: Jul. 7, 1998

[54] FLEXIBLE HIGH VOLTAGE TERMINAL FOR ELECTROMECHANICAL CONNECTION

[76] Inventors: Cedric J. Booker, 4019 Marcelle St., Compton, Calif. 90221; Douglas Shinno, 604 Fremont Ave., #2, South Passadena, Calif. 91030

[21] Appl. No.: 676,711

[22] Filed: Jul. 8, 1996

[51] Int. Cl.[6] ..... H01R 13/64

[52] U.S. Cl. ..... 439/246; 439/571

[58] Field of Search ..... 439/246, 700, 439/824, 247, 248, 252, 567, 571, 572

[56] References Cited

U.S. PATENT DOCUMENTS 4,307,928 12/1981 Petlock, Jr. ..... 439/824

*Primary Examiner*—Gary F. Paumen

[57] ABSTRACT

A unitary electrical terminal including an internally threaded connecting post (11), an intermediate section (13), a helical flexure section (15) connected between the connecting post and the intermediate section, and an anchoring section (17) attached to the intermediate section. In use, the anchoring section is embedded in encapsulant material of an electrical device.

9 Claims, 1 Drawing Sheet

FLEXIBLE HIGH VOLTAGE TERMINAL FOR ELECTROMECHANICAL CONNECTION

BACKGROUND OF THE INVENTION

The disclosed invention is generally directed to electrical terminals, and more particularly to a flexible electrical terminal for a high voltage capacitor module.

High voltage capacitor modules are commonly utilized by attachment of a rigid printed circuit board to electrical terminals embedded in the encapsulant of a high voltage capacitor module. In other words, the electrical terminals of the high voltage capacitor support the rigid printed circuit board and also provide the electrical connection between the high voltage capacitor and the rigid printed circuit board.

A consideration with known circuit board supporting terminals of high voltage capacitor modules includes breakage or cracking of the capacitor encapsulant during thermal expansion.

SUMMARY OF THE INVENTION

It would therefore be an advantage to provide an electrical terminal for a high voltage capacitor that can accommodate the different thermal expansion rates of the encapsulant of a high voltage capacitor module and a printed circuit board that is attached to the high voltage capacitor module by the electrical terminal.

The foregoing and other advantages are provided by the invention in a unitary electrical terminal including an internally threaded connecting post, an intermediate section, a helical flexure section connected between the connecting post and the intermediate section, and an anchoring section attached to the intermediate section, wherein the anchoring section is configured to be embedded in encapsulant material of an electrical device.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
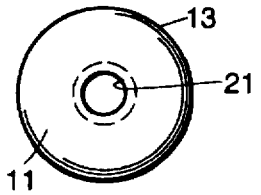
FIG. 1 is a schematic top plan view of an electrical terminal in accordance with the invention.

In the following detailed description and in the several figures of the drawing, like elements are identified with like reference numerals.

Figure 2:
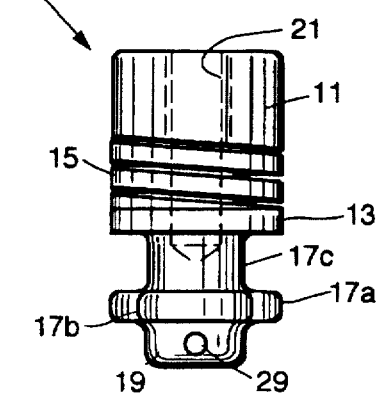
FIG. 2 is a schematic elevational view of the electrical terminal of FIG. 1.
Figure 3:
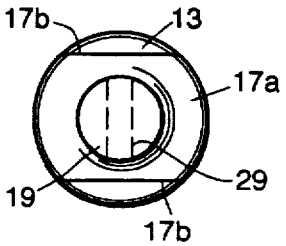
FIG. 3 is a schematic bottom plan view of the electrical terminal of FIG. 1.

Referring now to FIGS. 1–3, set forth therein is an electrical terminal 10 in accordance with the invention. The terminal comprises a unitary metal structure such as copper that includes in linear arrangement a connecting post 11, an intermediate section 13, a flexure section 15 attached between the connecting post 11 and the intermediate section 13, an anchoring section 17 connected to the intermediate section 13, and a connecting hub 19. A central bore 21 is formed in the connecting post 11 and the flexure section 15, and an aperture 29 is formed in the connecting hub 19. The portion of the central bore 21 in the connecting post 11 is threaded for accepting a threaded fastener.

By way of illustrative example, the portion of the terminal comprised of the connecting post 11, the flexure section 15 and the intermediate section 13 is more particularly conical with a very slight taper (e.g., 1 degree) such that the end of the connecting post is slightly narrower than the intermediate section 13. Alternatively, the portion of the terminal comprised of the connecting post 11 and the flexure section 15 can be cylindrical.

The flexure section 15 more particularly comprises a helix having two or three turns. The diameter of the bore 21 of the helix is less than 50 percent of the smallest diameter of the flexure section 15, whereby the radial thickness of the helix coil or turns is greater than 25 percent of the smallest diameter of the flexure section 15.

The anchoring section 17 generally comprises a disk shaped element **17*a* having opposing flats 17*b* formed in the edge thereof, and a neck portion 17*c* which is narrower than the disk shaped portion 17*a* and the intermediate section 13. The anchoring section 17** can also be considered as a post having a flange extending radially therefrom.

By way of illustrative example, the unitary electrical terminal 10 of FIGS. 1–3 is machined from a single piece of a suitable metal, such as a short copper rod.

Figure 4:
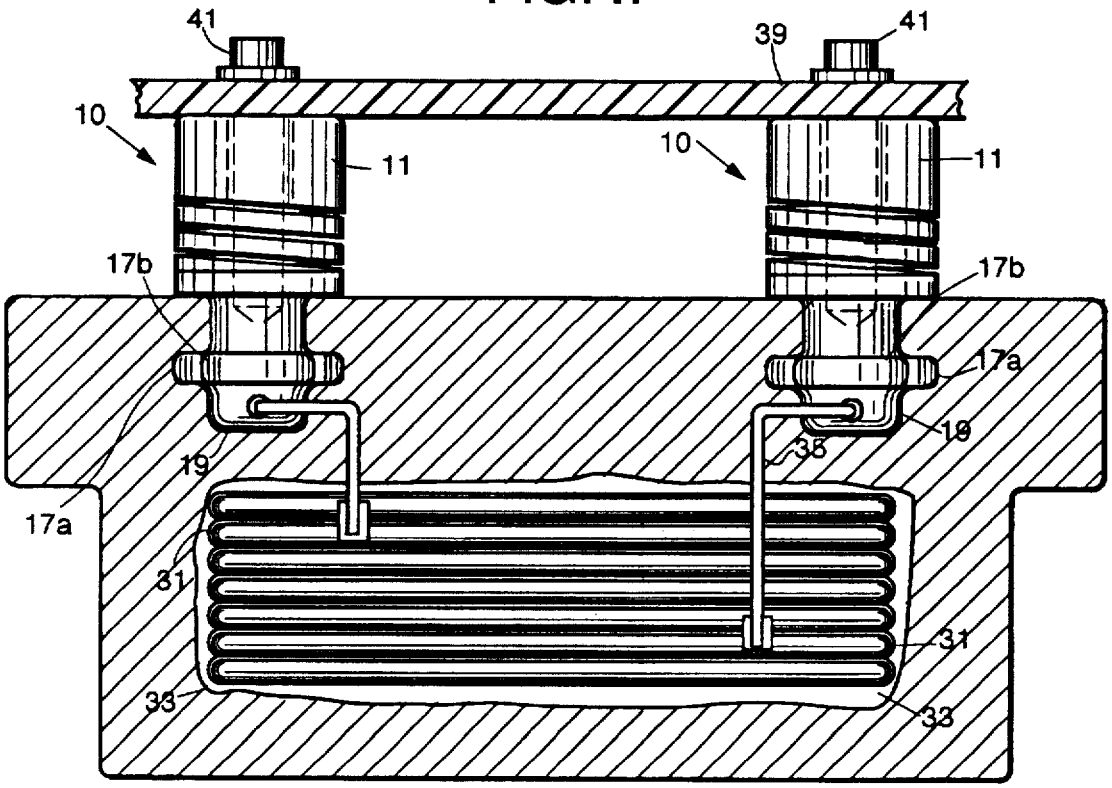
FIG. 4 is a schematic view illustrating a use of the electrical terminal of FIGS. 1–3.

Referring now to FIG. 4, a plurality of electrical terminals 10 are utilized in a high voltage capacitor structure that includes a stack of capacitors 31, potting material 33 that surrounds the stack of capacitors 31, a plurality of electrical terminals 10, and wires 35 connected between the stack of capacitors 31 and the connecting hubs 19 of the electrical terminals. An encapsulant 37 that is molded around the stack of capacitors 31 and the potting material 33 to form the case of the capacitor structure, with the anchoring section 17 and the connecting hub 19 of each electrical terminal 10 being embedded below the top surface of the encapsulant 37. A printed wiring board 39 is attached to each of the electrical terminals 10 by a respective threaded fastener 41. The flats **17*b* in the anchoring section 17 prevent the terminals 10 from spinning when the threaded fasteners 41** are attached.

The foregoing has thus been a disclosure of an electrical terminal that advantageously provides for flexure so as to avoid cracking or breaking of the component in which it is incorporated.

Although the foregoing has been a description and illustration of specific embodiments of the invention, various modifications and changes thereto can be made by persons skilled in the art without departing from the scope and spirit of the invention as defined by the following claims.

What is claimed is:

1. A one piece electrical terminal comprising:

a connecting post having a threaded central bore;

an intermediate section;

a helical flexure section attached between said connecting post and said intermediate section, said helical flexure section including a central bore having a diameter that is less than 50 percent of a diameter of said helical flexure section; and an anchoring section attached to said intermediate section.

2. The one piece electrical terminal of claim 1 wherein said connecting post comprises a conical connecting post.

3. The one piece electrical terminal of claim 1 wherein said connecting post comprises a cylindrical connecting post.

4. The one piece electrical terminal of claim 1 wherein said helical flexure section includes two turns.

5. The one piece electrical terminal of claim 1 wherein said helical flexure section includes three turns.

6. The one piece electrical terminal of claim 1 wherein said anchoring section includes a disk shaped element and neck portion disposed between said flexure section and said disk shaped element.

7. The one piece electrical terminal of claim 1 wherein said disk shaped element includes opposing flats.

8. The one piece electrical terminal of claim 1 wherein said anchoring section includes a post attached to said flexure section and a flange extending radially from said post.

9. The one piece electrical terminal of claim 1 wherein said flange includes opposing flats.

* * * * *